US010136209B2

(12) United States Patent
Su et al.

(10) Patent No.: US 10,136,209 B2
(45) Date of Patent: Nov. 20, 2018

(54) METHOD, APPARATUS, AND SYSTEM FOR SUPPLYING POWER TO ACTIVE NOISE REDUCTION HEADSET

(71) Applicant: Huawei Technologies Co., Ltd., Shenzhen (CN)

(72) Inventors: Wei Su, Shenzhen (CN); Huogen Kuang, Shanghai (CN); Yudi Zhou, Shenzhen (CN); Zhiqiang Zhang, Shenzhen (CN); Zhonghui Peng, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/364,033

(22) Filed: Nov. 29, 2016

(65) Prior Publication Data

US 2017/0085978 A1 Mar. 23, 2017

Related U.S. Application Data

(63) Continuation of application No. PCT/CN2014/079011, filed on May 30, 2014.

(51) Int. Cl.
*H04R 1/10* (2006.01)

(52) U.S. Cl.
CPC ..... *H04R 1/1041* (2013.01); *H04R 1/1025* (2013.01); *H04R 2201/107* (2013.01);
(Continued)

(58) Field of Classification Search
CPC ..... H04R 1/1041; H04R 1/1025; H04R 2201/107; H04R 2430/01; H04R 2460/01; H04R 2430/03
See application file for complete search history.

(56) References Cited

U.S. PATENT DOCUMENTS 5,226,077 A * 7/1993 Lynn ..... H04M 1/6033 379/214.01
8,290,171 B1 * 10/2012 Helfrich ..... H04R 5/033 381/111

(Continued)

FOREIGN PATENT DOCUMENTS

CN 101493728 A * 7/2009
CN 201886411 U 6/2011

(Continued)

OTHER PUBLICATIONS

KR 10-2016-7036283, Office Action, dated Jul. 19, 2017.

*Primary Examiner* — Sonia Gay
(74) *Attorney, Agent, or Firm* — Leydig, Voit & Mayer, Ltd.

(57) ABSTRACT

Embodiments of the present invention provide a method, an apparatus, and a system for supplying power to an active noise reduction headset The method for supplying power to an active noise reduction headset includes: receiving a signal of first voltage transmitted by the terminal; processing the signal of the first voltage to obtain a signal of second voltage, where the second voltage is less than the first voltage, and the signal of the second voltage is transmitted to a noise reduction chip of the active noise reduction headset, so that the noise reduction chip of the active noise reduction headset acquires the signal of the second voltage to implement a noise reduction function. The method, apparatus, and system for supplying power to an active noise reduction headset provided in the embodiments of the present invention are used to supply power to the active noise reduction headset.

10 Claims, 8 Drawing Sheets

(52) U.S. Cl.
CPC ..... *H04R 2430/01* (2013.01); *H04R 2460/01* (2013.01); *H04R 2460/03* (2013.01)

(56) References Cited

U.S. PATENT DOCUMENTS

| | | | | |
|---|---|---|---|---|
| 2005/0013447 | A1* | 1/2005 | Crump | H02M 3/156 381/71.6 |
| 2006/0067544 | A1* | 3/2006 | Moraghan | H04R 25/502 381/113 |
| 2007/0131445 | A1 | 6/2007 | Gustavsson | |
| 2008/0032753 | A1 | 2/2008 | Nho | |
| 2008/0057857 | A1 | 3/2008 | Smith | |
| 2008/0057858 | A1 | 3/2008 | Smith | |
| 2008/0205663 | A1 | 8/2008 | Crump et al. | |
| 2008/0290840 | A1* | 11/2008 | Paul | H02J 7/0073 320/162 |
| 2009/0073950 | A1* | 3/2009 | Guccione | H04M 1/05 370/341 |
| 2009/0180643 | A1* | 7/2009 | Sander | H04M 1/05 381/111 |
| 2013/0083927 | A1 | 4/2013 | Savant | |
| 2014/0010390 | A1 | 1/2014 | Zhang et al. | |
| 2014/0079236 | A1 | 3/2014 | Yamkovoy | |
| 2014/0219468 | A1 | 8/2014 | Nho | |
| 2015/0038133 | A1* | 2/2015 | Einzig | H04W 8/22 455/419 |
| 2015/0161979 | A1 | 6/2015 | Li et al. | |
| 2015/0237435 | A1 | 8/2015 | Wong et al. | |
| 2015/0296286 | A1* | 10/2015 | Prentice | H04R 1/1083 381/71.6 |
| 2017/0257702 | A1* | 9/2017 | O'Connor | H04R 3/12 |

FOREIGN PATENT DOCUMENTS

| | | | | |
|---|---|---|---|---|
| CN | 102624957 | A | * | 8/2012 |
| CN | 103248976 | A | | 8/2013 |
| CN | 103260105 | A | | 8/2013 |
| CN | 203251411 | U | | 10/2013 |
| CN | 203251413 | U | | 10/2013 |
| EP | 1499017 | A2 | | 1/2005 |
| JP | H0531494 | U | | 4/1993 |
| JP | 2005039834 | A | | 2/2005 |
| JP | 2009545260 | A | | 12/2009 |
| WO | 2008014422 | A1 | | 1/2008 |

* cited by examiner 4-a 4-b

METHOD, APPARATUS, AND SYSTEM FOR SUPPLYING POWER TO ACTIVE NOISE REDUCTION HEADSET

CROSS-REFERENCE TO RELATED APPLICATIONS

This application is a continuation of International Application No. PCT/CN2014/079011, filed on May 30, 2014, the disclosure of which is hereby incorporated by reference in its entirety.

TECHNICAL FIELD

The present invention relates to the field of electronic products, and in particular, to a method, an apparatus, and a system for supplying power to an active noise reduction headset.

BACKGROUND

With development of electronic technologies, functions of electronic products are increasingly powerful. An active noise reduction headset generates a backward sound wave equal to noise by using a noise reduction chip, and neutralizes the noise by using a backward sound wave of the noise, so that a noise reduction effect is achieved. The active noise reduction headset includes an audio receiver, a noise reduction chip, and an audio output unit. The noise reduction chip is separately connected to the audio receiver and the audio output unit, the audio receiver may be a tiny microphone, and the audio output unit may be a loudspeaker. It is assumed that a first audio input signal is a noise signal, after the audio receiver receives the first audio input signal and outputs the first audio input signal to the noise reduction chip, the noise reduction chip generates a second audio input signal, where the second audio input signal and the first audio input signal have a same amplitude and opposite phases. Then the noise reduction chip outputs the second audio input signal to the audio output unit, and the audio output unit outputs the second audio input signal, so that the first audio input signal is weakened or cancelled, thereby achieving a purpose of shielding the noise by the active noise reduction headset. When the noise reduction chip weakens or cancels the received first audio input signal, power needs to be supplied to the noise reduction chip.

In the prior art, a lithium-ion battery may be disposed within the active noise reduction headset, and the lithium-ion battery supplies power to the noise reduction chip. In addition, a charger provided for charging the lithium-ion battery is configured for the active noise reduction headset. When the noise reduction chip works for a relatively long period of time, the lithium-ion battery also needs to supply power to the noise reduction chip within the relatively long period of time accordingly, and when the lithium-ion battery is out of power, the charger needs to charge the lithium-ion battery, so that the lithium-ion battery supplies power to the noise reduction chip. Therefore, a power supply operation of the active noise reduction headset is highly complex.

SUMMARY

Embodiments of the present invention provide a method, an apparatus, and a system for supplying power to an active noise reduction headset to resolve a problem that a power supply operation of the active noise reduction headset is highly complex.

To achieve the foregoing objective, the following technical solutions are used in the embodiments of the present invention:

According to a first aspect, a method for supplying power to an active noise reduction headset is provided, where the active noise reduction headset is connected to a terminal, and the method includes:

receiving, by the active noise reduction headset, a signal of first voltage transmitted by the terminal; and processing, by the active noise reduction headset, the signal of the first voltage to obtain a signal of second voltage, where the second voltage is less than the first voltage, and the signal of the second voltage is transmitted to a noise reduction chip of the active noise reduction headset, so that the noise reduction chip of the active noise reduction headset acquires the signal of the second voltage to implement a noise reduction function.

With reference to the first aspect, in a first possible implementation manner, the receiving a signal of first voltage transmitted by the terminal includes:

receiving, by the active noise reduction headset by using a microphone cable of the active noise reduction headset, the signal of the first voltage transmitted by the terminal.

With reference to the first possible implementation manner, in a second possible implementation manner, the processing the signal of the first voltage to obtain a signal of second voltage includes:

processing, by the active noise reduction headset, the signal of the first voltage to obtain a signal of third voltage, where the third voltage is less than the first voltage, and the signal of the third voltage is transmitted to a rechargeable battery of the active noise reduction headset, so that the rechargeable battery stores the signal of the third voltage; and processing, by the active noise reduction headset, the signal of the third voltage to obtain the signal of the second voltage, where the third voltage is greater than the second voltage.

With reference to the first or the second possible implementation manner, in a third possible implementation manner, after the receiving a signal of first voltage transmitted by the terminal, the method further includes:

receiving, by the active noise reduction headset by using the microphone cable of the active noise reduction headset, a trigger signal triggered by a user; and transmitting, by the active noise reduction headset, the trigger signal to the terminal by using the microphone cable of the active noise reduction headset, so that the terminal interrupts or switches a transmit signal of the terminal according to the trigger signal, where the transmit signal is a data signal or a voice signal transmitted by the terminal to the active noise reduction headset.

According to a second aspect, a method for supplying power to an active noise reduction headset is provided, where the active noise reduction headset is connected to a terminal, and the method includes:

acquiring, by the terminal, a signal of power source voltage provided by a power source of the terminal;

processing, by the terminal, the signal of the power source voltage of the terminal to obtain a signal of first voltage, where the power source voltage is less than the first voltage; and transmitting, by the terminal, the signal of the first voltage to the active noise reduction headset, so that the active noise reduction headset processes the signal of the first voltage to obtain a signal of second voltage, where the signal of the second voltage is transmitted to a noise reduction chip of the active noise reduction headset, so that the noise reduction chip of the active noise reduction headset acquires the signal of the second voltage to implement a noise reduction function, where the second voltage is less than the first voltage.

With reference to the second aspect, in a first possible implementation manner, after the transmitting the signal of the first voltage to the active noise reduction headset, the method further includes:

receiving, by the terminal, a trigger signal transmitted by a microphone cable of the active noise reduction headset, where the trigger signal is generated by a user by means of triggering; and interrupting or switching, by the terminal, a transmit signal of the terminal according to the trigger signal, where the transmit signal is a data signal or a voice signal transmitted by the terminal to the active noise reduction headset.

According to a third aspect, an active noise reduction headset is provided, where the active noise reduction headset is connected to a terminal, and the active noise reduction headset includes:

a receiver circuit, configured to receive a signal of first voltage transmitted by the terminal; and a voltage step-down circuit, configured to process the signal of the first voltage to obtain a signal of second voltage, where the second voltage is less than the first voltage, and the signal of the second voltage is transmitted to a noise reduction chip of the active noise reduction headset, so that the noise reduction chip of the active noise reduction headset acquires the signal of the second voltage to implement a noise reduction function.

With reference to the third aspect, in a first possible implementation manner, the receiver circuit is specifically configured to:

receive, by using a microphone cable of the active noise reduction headset, the signal of the first voltage transmitted by the terminal.

With reference to the first possible implementation manner, in a second possible implementation manner, the voltage step-down circuit includes:

a first processing circuit, configured to process the signal of the first voltage to obtain a signal of third voltage, where the third voltage is less than the first voltage, and the signal of the third voltage is transmitted to a rechargeable battery of the active noise reduction headset, so that the rechargeable battery stores the signal of the third voltage; and a second processing circuit, configured to process the signal of the third voltage to obtain the signal of the second voltage, where the third voltage is greater than the second voltage.

With reference to the first possible implementation manner, in a third possible implementation manner, the voltage step-down circuit includes:

a voltage step-down chip, where an input end of the voltage step-down chip is connected to the microphone cable of the active noise reduction headset, and an output end of the voltage step-down chip is connected to an input end of the noise reduction chip of the active noise reduction headset.

With reference to the second possible implementation manner, in a fourth possible implementation manner, the first processing circuit includes a charging chip, and the second processing circuit includes a voltage step-down chip; where an input end of the charging chip is connected to the microphone cable of the active noise reduction headset, one end of the rechargeable battery is separately connected to an output end of the charging chip and an input end of the voltage step-down chip, the other end of the rechargeable battery is grounded, and an output end of the voltage step-down chip is connected to an input end of the noise reduction chip of the active noise reduction headset.

With reference to the first or the second possible implementation manner, in a fifth possible implementation manner, the receiver circuit is further configured to receive, by using the microphone cable of the active noise reduction headset, a trigger signal triggered by a user; and the active noise reduction headset further includes:

a trigger circuit, configured to transmit the trigger signal to the terminal by using the microphone cable of the active noise reduction headset, so that the terminal interrupts or switches a transmit signal of the terminal according to the trigger signal, where the transmit signal is a data signal or a voice signal transmitted by the terminal to the active noise reduction headset.

With reference to the fifth possible implementation manner, in a sixth possible implementation manner, the trigger circuit includes:

a button switch and a resistor R1, where one end of the resistor R1 is grounded, the other end of the resistor R1 is connected to the button switch in series, the button switch is connected to the microphone cable of the active noise reduction headset, and when a trigger signal indicating that the user triggers the active noise reduction headset is received by using the microphone cable of the active noise reduction headset, the button switch and the resistor R1 are conducted.

According to a fourth aspect, a terminal is provided, where the terminal is connected to an active noise reduction headset, and the terminal includes:

a power source, configured to provide power source voltage to the terminal; and a voltage step-up circuit, configured to process a signal of the power source voltage of the terminal to obtain a signal of first voltage, where the power source voltage is less than the first voltage; and the voltage step-up circuit is further configured to transmit the signal of the first voltage to the active noise reduction headset, so that the active noise reduction headset processes the signal of the first voltage to obtain a signal of second voltage, where the signal of the second voltage is transmitted to a noise reduction chip of the active noise reduction headset, so that the noise reduction chip of the active noise reduction headset acquires the signal of the second voltage to implement a noise reduction function, where the second voltage is less than the first voltage.

With reference to the fourth aspect, in a first possible implementation manner, the voltage step-up circuit includes:

a voltage step-up chip, where an input end of the voltage step-up chip is connected to an output end of the power source of the terminal, and an output end of the voltage step-up chip is connected to a microphone cable of the active noise reduction headset.

With reference to the first possible implementation manner, in a second possible implementation manner, the terminal further includes:

a trigger circuit, configured to receive a trigger signal transmitted by the microphone cable of the active noise reduction headset, where the trigger signal is generated by a user by means of triggering; and the trigger circuit is further configured to interrupt or switch a transmit signal of the terminal according to the trigger signal, where the transmit signal is a data signal or a voice signal transmitted by the terminal to the active noise reduction headset.

With reference to the second possible implementation manner, in a third possible implementation manner, the trigger circuit includes:

a resistor R2 and a comparator; where one end of the resistor R2 is separately connected to the output end of the voltage step-up chip and a first input end of the comparator, and the other end of the resistor R2 is separately connected to the microphone cable of the active noise reduction headset and a second input end of the comparator.

According to a fifth aspect, a power supply system is provided, including: any active noise reduction headset mentioned above and any terminal mentioned above, where the terminal is configured to acquire a signal of power source voltage provided by a power source of the terminal, process the signal of the power source voltage of the terminal to obtain a signal of first voltage, where the power source voltage is less than the first voltage; and transmit the signal of the first voltage to the active noise reduction headset, so that the active noise reduction headset processes the signal of the first voltage to obtain a signal of second voltage, where the signal of the second voltage is transmitted to a noise reduction chip of the active noise reduction headset, so that the noise reduction chip of the active noise reduction headset acquires the signal of the second voltage to implement a noise reduction function, where the second voltage is less than the first voltage; and the active noise reduction headset is configured to receive the signal of the first voltage transmitted by the terminal; and process the signal of the first voltage to obtain the signal of the second voltage, where the second voltage is less than the first voltage, and the signal of the second voltage is transmitted to the noise reduction chip of the active noise reduction headset, so that the noise reduction chip of the active noise reduction headset acquires the signal of the second voltage to implement a noise reduction function.

The embodiments of the present invention provide a method, an apparatus, and a system for supplying power to an active noise reduction headset, where the method for supplying power to an active noise reduction headset includes: receiving, by the active noise reduction headset, a signal of first voltage transmitted by the terminal; processing, by the active noise reduction headset, the signal of the first voltage to obtain a signal of second voltage, where the second voltage is less than the first voltage, and the signal of the second voltage is transmitted to a noise reduction chip of the active noise reduction headset, so that the noise reduction chip of the active noise reduction headset acquires the signal of the second voltage to implement a noise reduction function. In this way, after an active noise reduction headset is connected to a terminal, the active noise reduction headset may receive a signal of first voltage transmitted by the terminal, and then process the signal of the first voltage to obtain a signal of second voltage, so that a noise reduction chip of the active noise reduction headset acquires the signal of the second voltage to implement a noise reduction function; therefore, the terminal connected to the active noise reduction headset supplies power to the active noise reduction headset, which can effectively resolve a problem that a power supply operation of the active noise reduction headset is highly complex.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Figure 1:
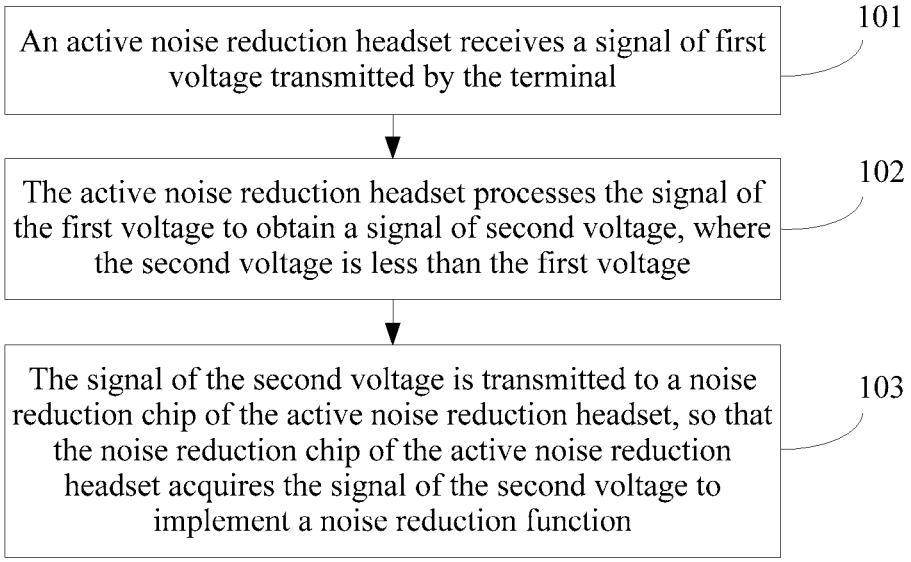
FIG. 1 is a flowchart of a method for supplying power to an active noise reduction headset according to an embodiment of the present invention.

An embodiment of the present invention provides a method for supplying power to an active noise reduction headset, where the active noise reduction headset is connected to a terminal. As shown in FIG. 1, the method includes the following steps:

Step 101: The active noise reduction headset receives a signal of first voltage transmitted by the terminal.

The signal of the first voltage transmitted by the terminal may be received by using a microphone cable of the active noise reduction headset.

Step 102: The active noise reduction headset processes the signal of the first voltage to obtain a signal of second voltage, where the second voltage is less than the first voltage.

The active noise reduction headset may directly process the signal of the first voltage to obtain the signal of the second voltage; or may first process the signal of the first voltage to obtain a signal of third voltage, where the third voltage is less than the first voltage; then the signal of the third voltage is transmitted to a rechargeable battery of the active noise reduction headset, so that the rechargeable battery stores the signal of the third voltage, and the active noise reduction headset processes the signal of the third voltage to obtain the signal of the second voltage, where the third voltage is greater than the second voltage.

Step 103: The signal of the second voltage is transmitted to a noise reduction chip of the active noise reduction headset, so that the noise reduction chip of the active noise reduction headset acquires the signal of the second voltage to implement a noise reduction function.

In this way, after an active noise reduction headset is connected to a terminal, the active noise reduction headset may receive a signal of first voltage transmitted by the terminal, and then process the signal of the first voltage to obtain a signal of second voltage, so that a noise reduction chip of the active noise reduction headset acquires the signal of the second voltage to implement a noise reduction function; therefore, the terminal connected to the active noise reduction headset supplies power to the active noise reduction headset, which can effectively resolve a problem that a power supply operation of the active noise reduction headset is highly complex.

Figure 2:
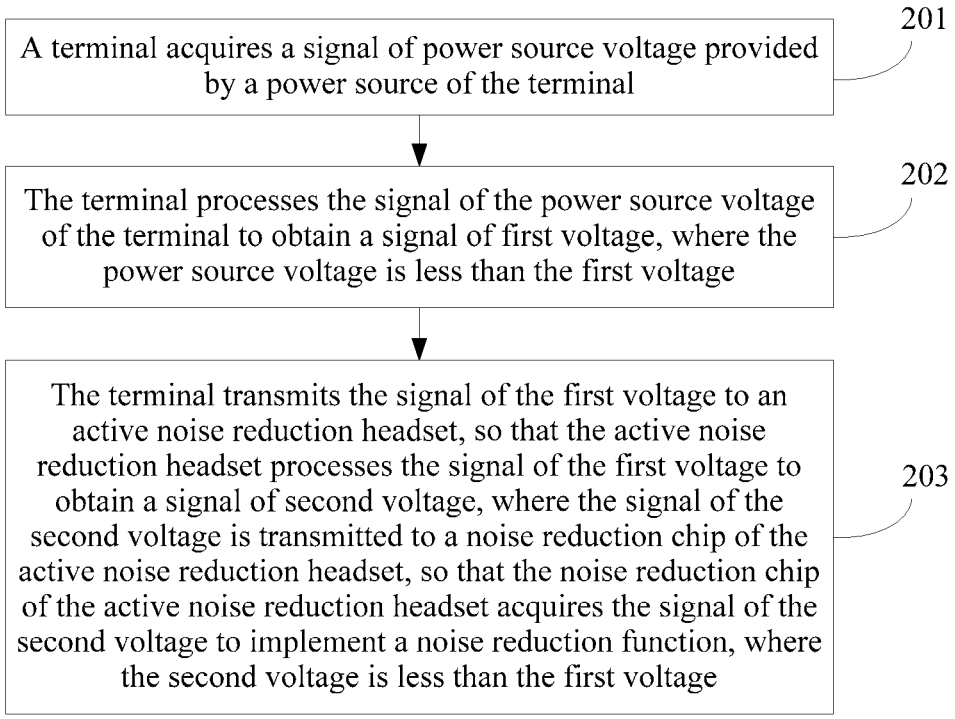
FIG. 2 is a flowchart of another method for supplying power to an active noise reduction headset according to an embodiment of the present invention.

An embodiment of the present invention provides a method for supplying power to an active noise reduction headset, where the active noise reduction headset is connected to a terminal. As shown in FIG. 2, the method includes the following steps:

Step 201: The terminal acquires a signal of power source voltage provided by a power source of the terminal.

Step 202: The terminal processes the signal of the power source voltage of the terminal to obtain a signal of first voltage, where the power source voltage is less than the first voltage.

Step 203: The terminal transmits the signal of the first voltage to the active noise reduction headset, so that the active noise reduction headset processes the signal of the first voltage to obtain a signal of second voltage, where the signal of the second voltage is transmitted to a noise reduction chip of the active noise reduction headset, so that the noise reduction chip of the active noise reduction headset acquires the signal of the second voltage to implement a noise reduction function, where the second voltage is less than the first voltage.

In this way, after an active noise reduction headset is connected to a terminal, the terminal may transmit a signal of first voltage to the active noise reduction headset. After receiving the signal of the first voltage, the active noise reduction headset processes the signal of the first voltage to obtain a signal of second voltage, so that a noise reduction chip of the active noise reduction headset acquires the signal of the second voltage to implement a noise reduction function; therefore, the terminal connected to the active noise reduction headset supplies power to the active noise reduction headset, which can effectively resolve a problem that a power supply operation of the active noise reduction headset is highly complex.

Figure 3:
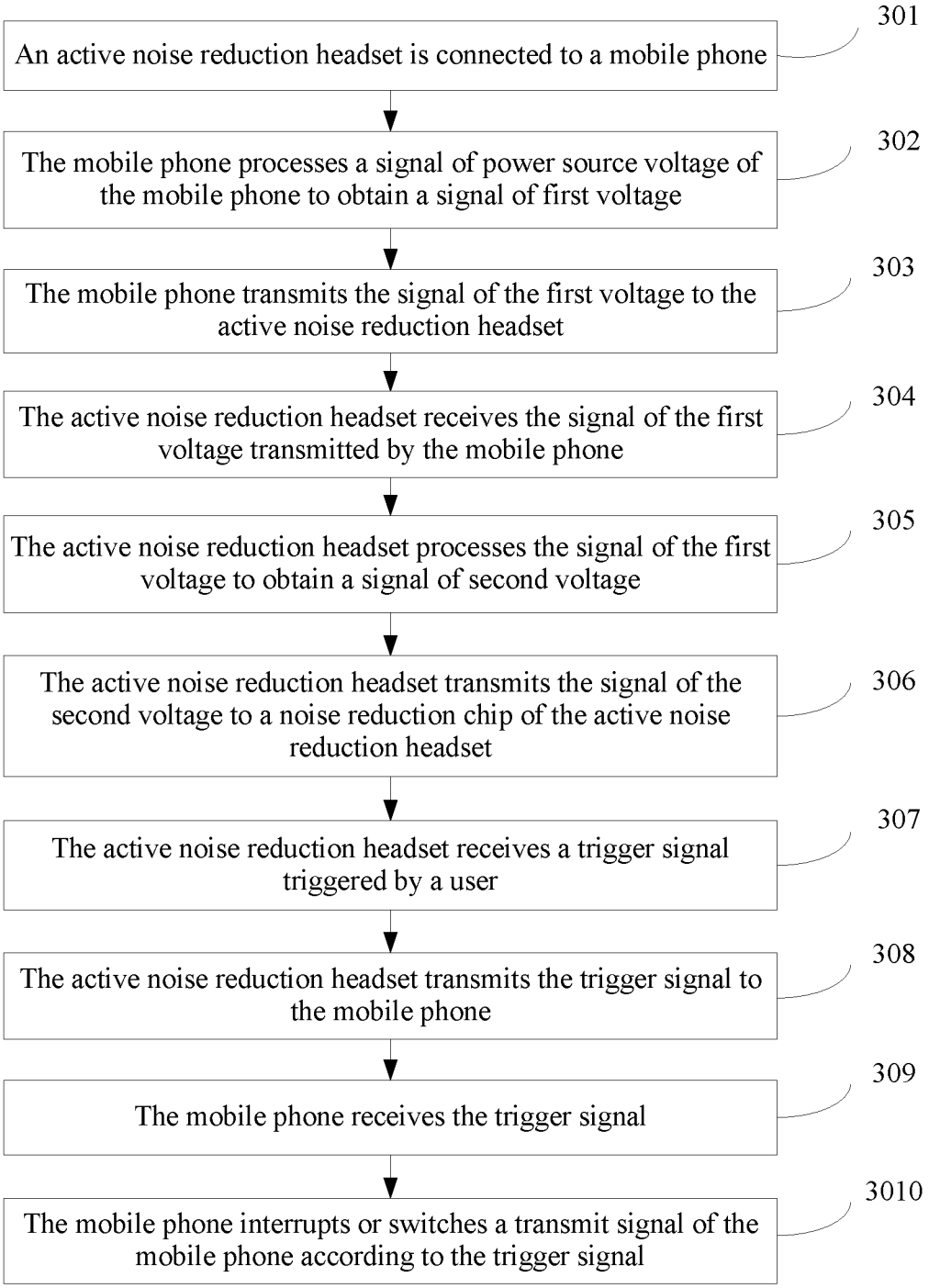
FIG. 3 is a flowchart of still another method for supplying power to an active noise reduction headset according to an embodiment of the present invention.

An embodiment of the present invention provides a method for supplying power to an active noise reduction headset, and it is assumed that a terminal is a mobile phone. As shown in FIG. 3, the method includes the following steps:

Step 301: The active noise reduction headset is connected to the mobile phone.

A headset plug of the active noise reduction headset is inserted into a headset jack of the mobile phone, so that the active noise reduction headset is connected to the mobile phone.

Figure 4:
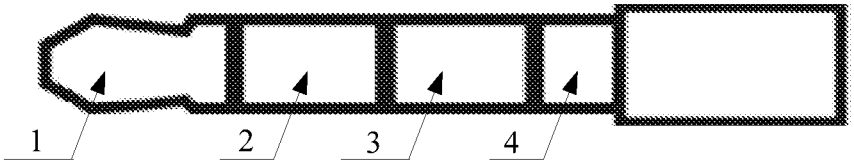
FIG. 4 is a schematic structural diagram of an active noise reduction headset according to an embodiment of the present invention.
Figure 4:
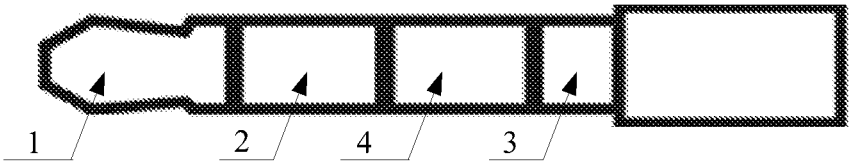

In the prior art, a size of the headset plug may be 3.5 mm with four segments. As shown in FIG. 4, cables of the headset plug may have two connection methods: The first connection method is shown in FIG. 4-*a*, being successively an audio-left channel cable (L) 1, an audio-right channel cable (R) 2, a microphone cable (MIC) 3, and a ground cable (GND) 4 from left to right. The second connection method is shown in FIG. 4-*b*, being successively the audio-left channel cable (L) 1, the audio-right channel cable (R) 2, the ground cable (GND) 4, and the microphone cable (MIC) 3 from left to right. When the active noise reduction headset is connected to the mobile phone, a pin of the headset plug of the active noise reduction headset must match a pin of the headset jack of the mobile phone, so that the mobile phone connected to the active noise reduction headset supplies power to the active noise reduction headset.

Step 302: The mobile phone processes a signal of power source voltage of the mobile phone to obtain a signal of first voltage.

The mobile phone increases voltage of the power source voltage of the power source of the mobile phone to obtain the signal of the first voltage, where the signal of the first voltage is a signal of output voltage of the mobile phone. Generally, the power source voltage of the mobile phone ranges from 3.2 V to 4.2 V, and the output voltage of the mobile phone is 5 V.

Step 303: The mobile phone transmits the signal of the first voltage to the active noise reduction headset.

The mobile phone transmits the signal of the first voltage to the active noise reduction headset by using a microphone cable of the active noise reduction headset.

Step 304: The active noise reduction headset receives the signal of the first voltage transmitted by the mobile phone.

The active noise reduction headset receives, by using the microphone cable of the active noise reduction headset, the signal of the first voltage transmitted by the mobile phone.

It should be noted that the active noise reduction headset according to the present invention needs to be an active noise reduction headset having a microphone function, that is, the active noise reduction headset has the microphone cable; therefore, the microphone cable of the active noise reduction headset is reused as a power cable of the active noise reduction headset, and the mobile phone supplies power to the active noise reduction headset by using the microphone cable of the active noise reduction headset.

Step 305: The active noise reduction headset processes the signal of the first voltage to obtain a signal of second voltage.

The active noise reduction headset may directly process the signal of the first voltage to obtain the signal of the second voltage, where the signal of the second voltage is transmitted to the noise reduction chip of the active noise reduction headset, and the second voltage is less than the first voltage.

Specially, first, the active noise reduction headset may process the signal of the first voltage to obtain a signal of third voltage, where the third voltage is less than the first voltage; then the signal of the third voltage is transmitted to a rechargeable battery and the voltage step-down chip of the active noise reduction headset, so that the rechargeable battery stores the signal of the third voltage, and the voltage step-down chip processes the signal of the third voltage to obtain the signal of the second voltage, where the third voltage is greater than the second voltage. In this way, if the active noise reduction headset is connected again to a mobile phone that cannot supply power to the active noise reduction headset, the active noise reduction headset can use electric energy stored by the rechargeable battery of the active noise reduction headset to supply power to the active noise reduction headset; or if the microphone cable of the active noise reduction headset is occupied, that is, the mobile phone is in a conversation state of a voice service, after receiving a voice signal, the active noise reduction headset outputs the received voice signal by using the microphone cable of the active noise reduction headset, and the active noise reduction headset can use the electric energy stored by the rechargeable battery of the active noise reduction headset to supply power to the active noise reduction headset. Compared with the prior art, the active noise reduction headset provided in the present invention can acquire the electric energy in real time to implement a noise reduction function, which can avoid changing a dry cell of the active noise reduction headset frequently because of power supply to the active noise reduction headset.

Step 306: The active noise reduction headset transmits the signal of the second voltage to a noise reduction chip of the active noise reduction headset.

The noise reduction chip of the active noise reduction headset acquires the signal of the second voltage to implement the noise reduction function.

Specially, according to this embodiment of the present invention, the microphone cable of the active noise reduction headset is used as the power cable of the active noise reduction headset, and if the microphone cable of the active noise reduction headset is not occupied, the mobile phone connected to the active noise reduction headset can supply power to the active noise reduction headset. Optionally, the mobile phone connected to the active noise reduction headset can charge the rechargeable battery of the active noise reduction headset, so as to charge the active noise reduction headset, so that the noise reduction chip of the active noise reduction headset acquires the signal of the second voltage to implement the noise reduction function.

If the microphone cable of the active noise reduction headset is occupied, the active noise reduction headset can use the signal of the third voltage stored by the rechargeable battery of the active noise reduction headset, and power is supplied to the active noise reduction headset by using the electric energy stored by the rechargeable battery of the active noise reduction headset, so that the noise reduction chip of the active noise reduction headset acquires the signal of the second voltage to implement the noise reduction function.

It should be noted that in a case in which the microphone cable of the active noise reduction headset is occupied, for example, when the mobile phone is in a conversation state of a voice service, the microphone cable of the active noise reduction headset is occupied because after a microphone of the active noise reduction headset receives a voice signal of a user, the voice signal is output by using the microphone cable of the active noise reduction headset; in a case in which the microphone cable of the active noise reduction headset is not occupied, for example, in a case in which the user does not use the microphone of the active noise reduction headset when the mobile phone is in a standby state or not in a conversation state of a voice service.

Step 307: The active noise reduction headset receives a trigger signal triggered by a user.

The user can press an answering button or a switching button disposed in the active noise reduction headset, and the active noise reduction headset receives, by using the microphone cable of the active noise reduction headset, a trigger signal triggered by the user. For example, the user can press a song switching button disposed in the active noise reduction headset, and the active noise reduction headset receives, by using the microphone cable of the active noise reduction headset, a trigger signal triggered by the user.

Step 308: The active noise reduction headset transmits the trigger signal to the mobile phone.

The active noise reduction headset transmits the trigger signal to the mobile phone by using the microphone cable of the active noise reduction headset.

Step 309: The mobile phone receives the trigger signal.

The mobile phone receives the trigger signal by using the microphone cable of the active noise reduction headset.

Step 3010: The mobile phone interrupts or switches a transmit signal of the mobile phone according to the trigger signal.

The mobile phone interrupts or switches the transmit signal of the mobile phone according to the trigger signal, which includes but is not limited to suspending or terminating the transmit signal of the mobile phone, where the transmit signal is a data signal or a voice signal transmitted by the mobile phone to the active noise reduction headset.

For example, when the mobile phone is playing a multimedia file such as a song or a video, if the user presses the answering button disposed in the active noise reduction headset, the active noise reduction headset receives, by using the microphone cable of the active noise reduction headset, a trigger signal triggered by the user, and then transmits the trigger signal to the mobile phone, and the mobile phone can suspend or stop, according to the received trigger signal, the song or video that is being played; or when the mobile phone is playing a multimedia file such as a song or a video, if the user presses the switching button disposed in the active noise reduction headset, the active noise reduction headset receives, by using the microphone cable of the active noise reduction headset, a trigger signal triggered by the user, and then transmits the trigger signal to the mobile phone, and the mobile phone can switch, according to the received trigger signal, the song or video that is being played; or when the mobile phone receives a call signal in a standby state, if the user presses the answering button disposed in the active noise reduction headset, the active noise reduction headset receives, by using the microphone cable of the active noise reduction headset, a trigger signal triggered by the user, and then transmits the trigger signal to the mobile phone, and the mobile phone can answer an incoming call according to the received trigger signal; or when the mobile phone is transmitting a voice signal in a conversation state, if the user presses the answering button disposed in the active noise reduction headset, the active noise reduction headset receives, by using the microphone cable of the active noise reduction headset, the trigger signal triggered by the user, and then transmits the trigger signal to the mobile phone, and the mobile phone can break a conversation according to the received trigger signal; the switching button and the answering button may be a same button or two buttons.

Optionally, the user may further trigger a virtual button or a physical button of the mobile phone. After receiving the trigger signal, the mobile phone can interrupt or switch a transmit signal of the mobile phone according to the trigger signal, which includes but is not limited to suspending or terminating the transmit signal of the mobile phone, where the transmit signal is a data signal or a voice signal transmitted by the mobile phone to the active noise reduction headset.

Steps 307-3010 are further optional.

According to the method for supplying power to an active noise reduction headset provided in this embodiment of the present invention, after the active noise reduction headset is connected to a mobile phone, first, the mobile phone processes a signal of power source voltage of the mobile phone to obtain a signal of first voltage, and transmits the signal of the first voltage to the active noise reduction headset; then the active noise reduction headset receives the signal of the first voltage transmitted by the mobile phone, processes the signal of the first voltage to obtain a signal of second voltage, transmits the signal of the second voltage to a noise reduction chip of the active noise reduction headset, so that the noise reduction chip of the active noise reduction headset acquires the signal of the second voltage to implement a noise reduction function. The active noise reduction headset may further receive a trigger signal triggered by a user on a button of the active noise reduction headset, and transmits the trigger signal to the mobile phone. After receiving the trigger signal, the mobile phone interrupts or switches a transmit signal of the mobile phone according to the trigger signal, or after receiving a trigger signal triggered by the user on the mobile phone, the mobile phone interrupts or switches a transmit signal of the mobile phone according to the trigger signal. Compared with the prior art, the mobile phone connected to the active noise reduction headset can supply power to the active noise reduction headset, so that the noise reduction chip of the active noise reduction headset implements the noise reduction function, which can effectively resolve a problem that a power supply operation of the active noise reduction headset is highly complex.

Figure 5:
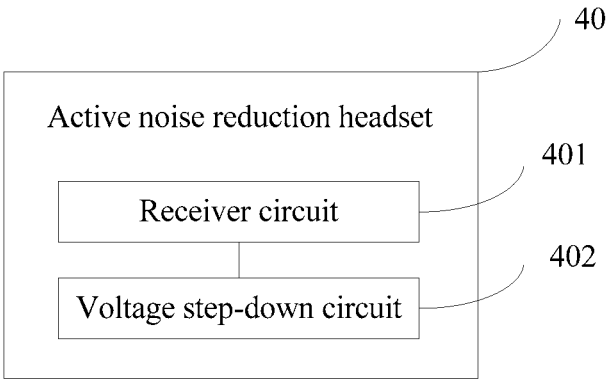
FIG. 5 is a schematic structural diagram of another active noise reduction headset according to an embodiment of the present invention.

An embodiment of the present invention provides an active noise reduction headset 40, where the active noise reduction headset is connected to a terminal. As shown in FIG. 5, the active noise reduction headset 40 includes:

a receiver circuit 401, configured to receive a signal of first voltage transmitted by the terminal; and a voltage step-down circuit 402, configured to process the signal of the first voltage to obtain a signal of second voltage, where the second voltage is less than the first voltage.

The signal of the second voltage is transmitted to a noise reduction chip of the active noise reduction headset, so that the noise reduction chip of the active noise reduction headset acquires the signal of the second voltage to implement a noise reduction function.

In this way, after an active noise reduction headset is connected to a terminal, the active noise reduction headset may receive a signal of first voltage transmitted by the terminal, and then process the signal of the first voltage to obtain a signal of second voltage, so that a noise reduction chip of the active noise reduction headset acquires the signal of the second voltage to implement a noise reduction function; therefore, the terminal connected to the active noise reduction headset supplies power to the active noise reduction headset, which can effectively resolve a problem that a power supply operation of the active noise reduction headset is highly complex.

The receiver circuit 401 is specifically configured to:

receive, by using a microphone cable of the active noise reduction headset, the signal of the first voltage transmitted by the terminal.

The receiver circuit 401 may be understood as the microphone cable and/or a headset plug of the active noise reduction headset.

The voltage step-down circuit 402 includes:

a voltage step-down chip, where an input end of the voltage step-down chip is connected to the microphone cable of the active noise reduction headset, and an output end of the voltage step-down chip is connected to an input end of the noise reduction chip of the active noise reduction headset.

In an embodiment, the voltage step-down chip is configured to process the received signal of the first voltage transmitted by the terminal to obtain the signal of the second voltage, where the second voltage is less than the first voltage. Then the signal of the second voltage is transmitted to the noise reduction chip of the active noise reduction headset, so that the noise reduction chip of the active noise reduction headset acquires the signal of the second voltage to implement the noise reduction function.

Figure 6:
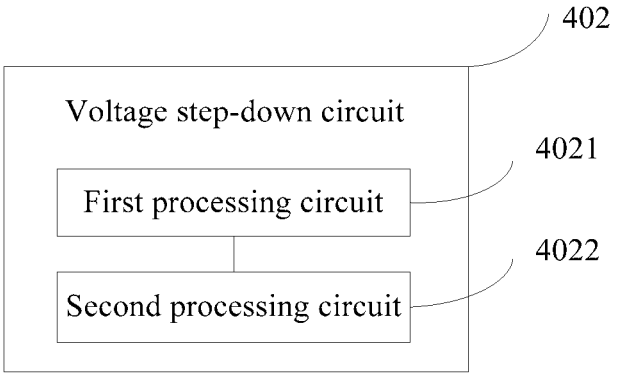
FIG. 6 is a schematic structural diagram of a voltage step-down circuit according to an embodiment of the present invention.

In another embodiment, as shown in FIG. 6, the voltage step-down circuit 402 includes:

a first processing circuit 4021, configured to process the signal of the first voltage to obtain a signal of third voltage, where the third voltage is less than the first voltage, and the signal of the third voltage is transmitted to a rechargeable battery of the active noise reduction headset, so that the rechargeable battery stores the signal of the third voltage; and a second processing circuit 4022, configured to process the signal of the third voltage to obtain the signal of the second voltage, where the third voltage is greater than the second voltage.

The first processing circuit 4021 includes a charging chip; the second processing circuit 4022 includes a voltage step-down chip.

An input end of the charging chip is connected to the microphone cable of the active noise reduction headset, one end of the rechargeable battery is separately connected to an output end of the charging chip and an input end of the voltage step-down chip, the other end of the rechargeable battery is grounded, and an output end of the voltage step-down chip is connected to an input end of the noise reduction chip of the active noise reduction headset.

The receiver circuit 401 is further configured to receive, by using the microphone cable of the active noise reduction headset, a trigger signal triggered by a user.

Figure 7:
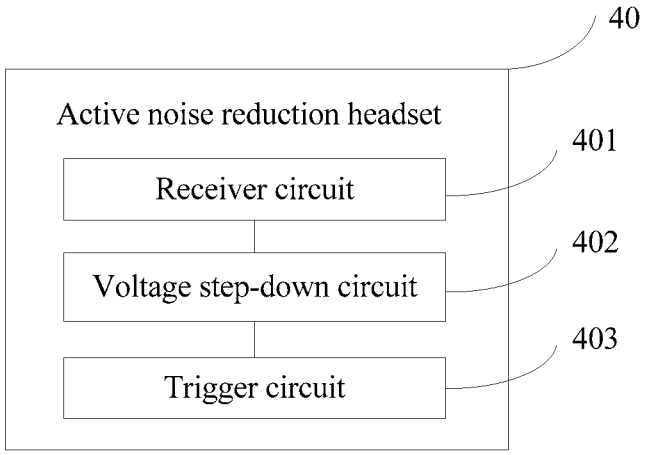
FIG. 7 is a schematic structural diagram of still another active noise reduction headset according to an embodiment of the present invention.

As shown in FIG. 7, the active noise reduction headset 40 further includes:

a trigger circuit 403, configured to transmit the trigger signal to the terminal by using the microphone cable of the active noise reduction headset, so that the terminal interrupts or switches a transmit signal of the terminal according to the trigger signal, where the transmit signal is a data signal or a voice signal transmitted by the terminal to the active noise reduction headset.

The trigger circuit 403 may include:

a button switch and a resistor R1, where one end of the resistor R1 is grounded, the other end of the resistor R1 is connected to the button switch in series, the button switch is connected to the microphone cable of the active noise reduction headset, and when a trigger signal indicating that the user triggers the active noise reduction headset is received by using the microphone cable of the active noise reduction headset, the button switch and the resistor R1 are conducted.

Figure 8:
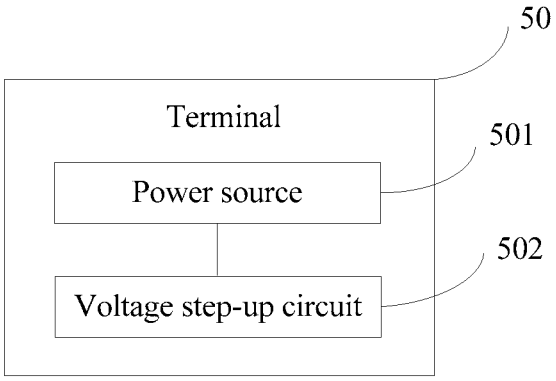
FIG. 8 is a schematic structural diagram of a terminal according to an embodiment of the present invention.

An embodiment of the present invention provides a terminal 50, where the terminal is connected to an active noise reduction headset. As shown in FIG. 8, the terminal 50 includes:

a power source 501, configured to provide power source voltage to the terminal; and a voltage step-up circuit 502, configured to process a signal of the power source voltage of the terminal to obtain a signal of first voltage, where the power source voltage is less than the first voltage.

The voltage step-up circuit 502 is further configured to transmit the signal of the first voltage to the active noise reduction headset, so that the active noise reduction headset processes the signal of the first voltage to obtain a signal of second voltage, where the signal of the second voltage is transmitted to a noise reduction chip of the active noise reduction headset, so that the noise reduction chip of the active noise reduction headset acquires the signal of the second voltage to implement a noise reduction function, where the second voltage is less than the first voltage.

In this way, after an active noise reduction headset is connected to a terminal, the terminal may transmit a signal of first voltage to the active noise reduction headset. After receiving the signal of the first voltage, the active noise reduction headset processes the signal of the first voltage to obtain a signal of second voltage, so that a noise reduction chip of the active noise reduction headset acquires the signal of the second voltage to implement a noise reduction function; therefore, the terminal connected to the active noise reduction headset supplies power to the active noise reduction headset, which can effectively resolve a problem that a power supply operation of the active noise reduction headset is highly complex.

The voltage step-up circuit 502 includes:

a voltage step-up chip, where an input end of the voltage step-up chip is connected to an output end of the power source of the terminal, and an output end of the voltage step-up chip is connected to a microphone cable of the active noise reduction headset.

Figure 9:
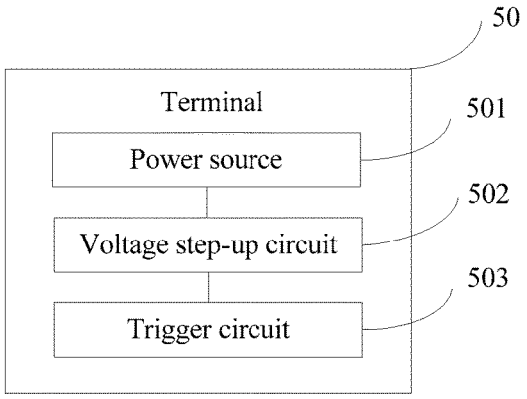
FIG. 9 is a schematic structural diagram of another terminal according to an embodiment of the present invention.

As shown in FIG. 9, the terminal 50 may further include:

a trigger circuit 503, configured to receive a trigger signal transmitted by the microphone cable of the active noise reduction headset, where the trigger signal is generated by a user by means of triggering.

The trigger circuit 503 is further configured to interrupt or switch a transmit signal of the terminal according to the trigger signal, where the transmit signal is a data signal or a voice signal transmitted by the terminal to the active noise reduction headset.

The trigger circuit 503 includes:

a resistor R2 and a comparator; where one end of the resistor R2 is separately connected to the output end of the voltage step-up chip and a first input end of the comparator, and the other end of the resistor R2 is separately connected to the microphone cable of the active noise reduction headset and a second input end of the comparator.

It should be noted that after the terminal receives the trigger signal transmitted by the microphone cable of the active noise reduction headset, the comparator obtains a voltage difference by comparing voltage at two ends of the resistor R2, obtains a level signal according to the voltage difference, and interrupts or switches the transmit signal of the terminal, where the level signal may include a high level signal and a low level signal.

Figure 10:
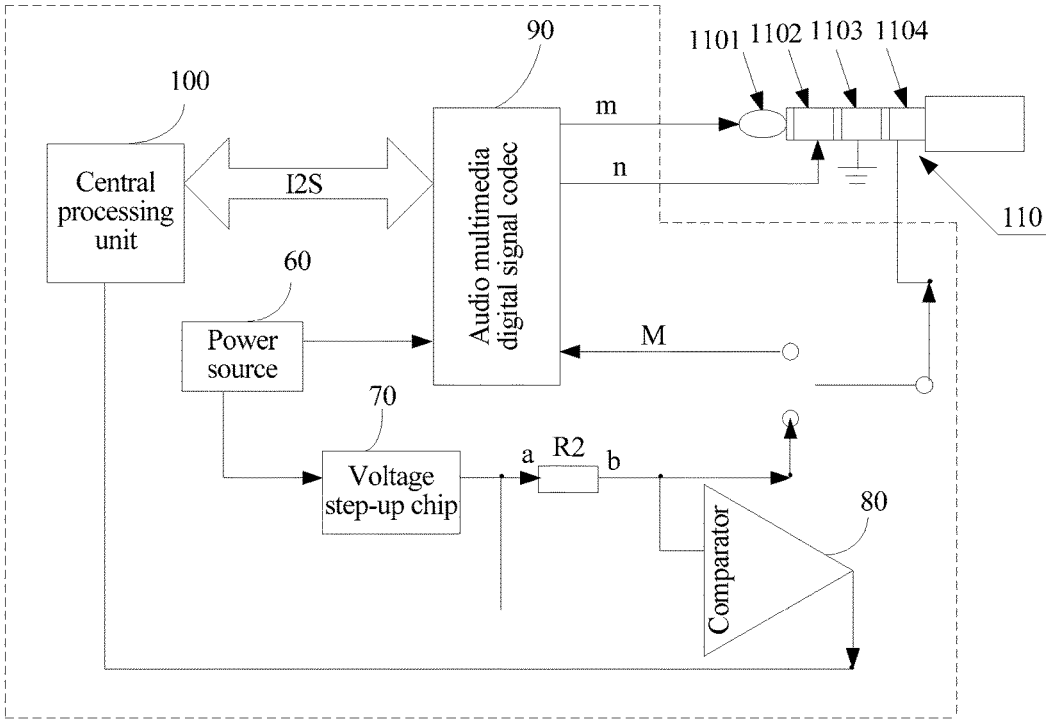
FIG. 10 is a schematic structural diagram of a mobile phone according to an embodiment of the present invention.

In an embodiment, exemplarily, it is assumed that a terminal is a mobile phone, and it is assumed that cables of a headset plug of an active noise reduction headset are successively an audio-left channel cable, an audio-right channel cable, a ground cable, and a microphone cable from left to right, and the active noise reduction headset is connected to the mobile phone, that is, the headset plug of the active noise reduction headset is inserted into a headset jack of the mobile phone. As shown in FIG. 10, the mobile phone includes: a power source 60, a voltage step-up chip 70, a resistor R2, a comparator 80, an audio multimedia digital signal codec 90, and a central processing unit 100, that is, components included in a dashed line box in FIG. 10.

The power source 60 is separately connected to an input end of the voltage step-up chip 70 and an input end of the audio multimedia digital signal codec 90; an end a of the resistor R2 is separately connected to an output end of the voltage step-up chip 70 and a first input end of the comparator 80, and an end b of the resistor R2 is connected to a second input end of the comparator 80; an output end of the comparator 80 is connected to the central processing unit 100; a left audio output end m of the audio multimedia digital signal codec 90 is connected to an audio-left channel cable 1101 of a headset plug 110 of the active noise reduction headset, a right audio output end n of the audio multimedia digital signal codec 90 is connected to an audio-right channel cable 1102 of the headset plug 110 of the active noise reduction headset, and the audio multimedia digital signal codec 90 is connected to the central processing unit 100 by using an audio bus 12S. It should be noted that a microphone cable 1104 of the headset plug 110 of the active noise reduction headset may be connected to a headset microphone cable M of the audio multimedia digital signal codec 90, or may be connected to the end b of the resistor R2; and the power source may be a lithium-ion battery.

Figure 11:
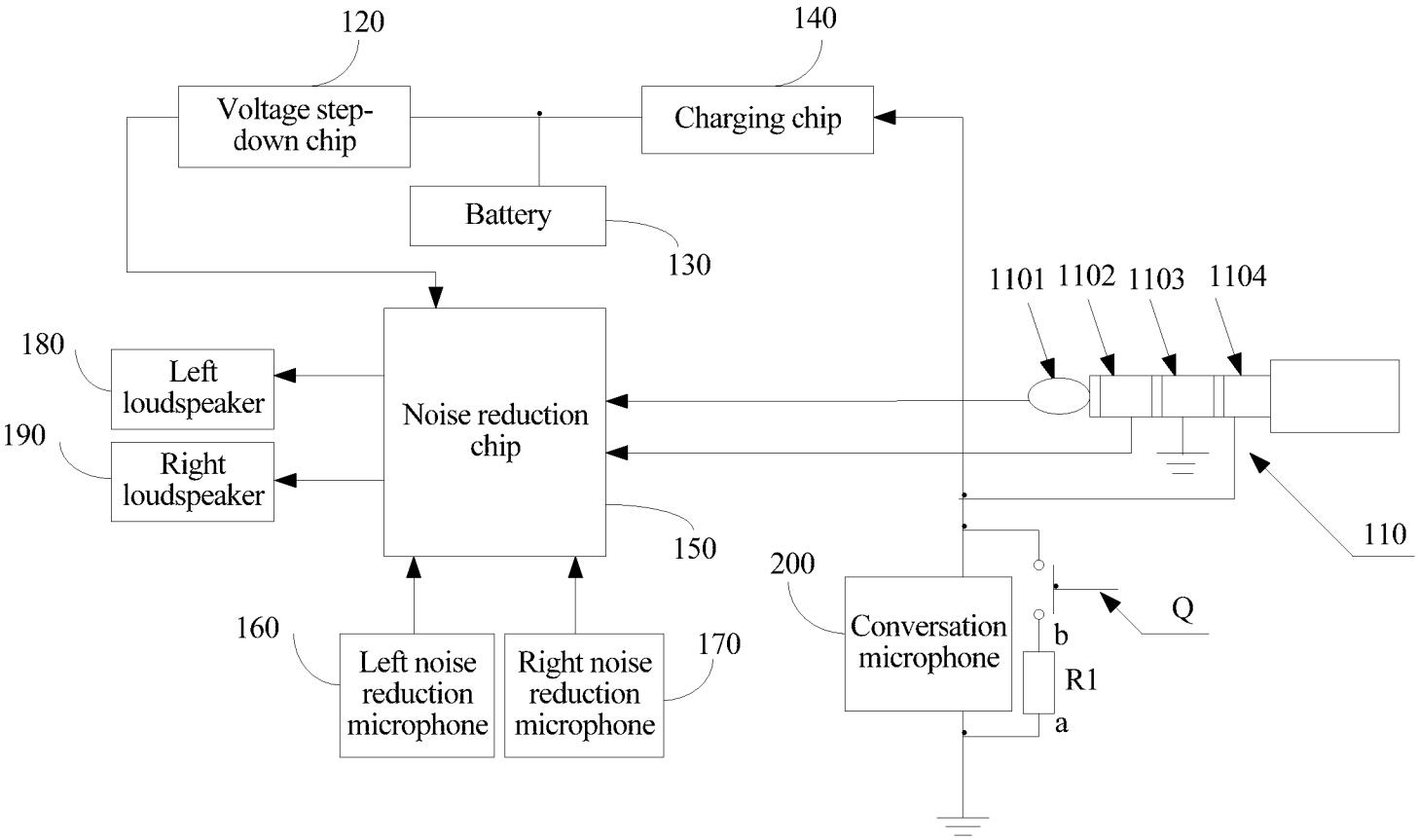
FIG. 11 is a schematic structural diagram of yet another active noise reduction headset according to an embodiment of the present invention.

As shown in FIG. 11, the active noise reduction headset may include: the headset plug 110 of the active noise reduction headset, a voltage step-down chip 120, a battery 130, a charging chip 140, a noise reduction chip 150, a left noise reduction microphone 160, a right noise reduction microphone 170, a left loudspeaker 180, a right loudspeaker 190, a conversation microphone 200, a resistor R1, and a button switch Q. The headset plug 110 of the active noise reduction headset includes the audio-left channel cable 1101, the audio-right channel cable 1102, a ground cable 1103, and the microphone cable 1104.

The microphone cable 1104 of the active noise reduction headset is connected to an input end of the charging chip 140 and one end of the conversation microphone 200, the other end of the conversation microphone 200 is grounded, an output end of the charging chip 140 is connected to an input end of the voltage step-down chip 120, the battery 130 is separately connected to the output end of the charging chip 140 and the input end of the voltage step-down chip 120, an output end of the voltage step-down chip 120 is connected to the noise reduction chip 150, the audio-right channel cable 1102 of the active noise reduction headset is connected to an audio-right channel input end of the noise reduction chip 150, an audio-right channel output end of the noise reduction chip 150 is connected to the right loudspeaker 190, the audio-left channel cable 1101 of the active noise reduction headset is connected to an audio-left channel input end of the noise reduction chip 150, an audio-left channel output end of the noise reduction chip 150 is connected to the left loudspeaker 180; the left noise reduction microphone 160 and the right noise reduction microphone 170 are separately connected to the noise reduction chip 150; an end a of the resistor R1 is grounded, and an end b of the resistor R1 is connected to the microphone cable 1104 of the active noise reduction headset. Generally, a battery may be a lithium-ion battery, and voltage of the lithium-ion battery ranges from 3.2 V to 4.2 V. A size of the headset plug of the active noise reduction headset may be 3.5 mm with four segments.

A power source of the mobile phone is configured to supply power to the mobile phone and the active noise reduction headset. It is assumed that the power source of the mobile phone can provide power source voltage with a voltage range of 3.2 V to 4.2 V, and output voltage of the mobile phone is 5 V. It should be noted that in this embodiment of the present invention, a microphone cable of the active noise reduction headset is used as a power cable of the active noise reduction headset, and the mobile phone supplies power to the active noise reduction headset by using the microphone cable of the active noise reduction headset.

If the microphone cable of the active noise reduction headset is not occupied, that is, if a user does not use a microphone of the active noise reduction headset when the mobile phone is in a standby state or not in a conversation state of a voice service, it is assumed that the user listens to music by using the mobile phone connected to the active noise reduction headset when the power source voltage of the mobile phone is 4 V, and the microphone cable of the active noise reduction headset is connected to the end b of the resistor R2; first, a voltage step-up chip increases voltage of 4 V power source voltage provided by the power source of the mobile phone to 5 V output voltage of the mobile phone, and performs voltage division as minimum as possible by using the resistor R2, transmits, by using the microphone cable of the active noise reduction headset, a 5 V voltage signal after voltage division to the charging chip of the active noise reduction headset; then the charging chip decreases, according to voltage of a battery, the 5 V voltage after voltage division to voltage that helps charge the battery. It is assumed that the 5 V voltage after voltage division is decreased to the 4 V voltage, the charging chip transmits the 4 V voltage to the battery to charge the battery, and the charging chip transmits the 4 V voltage to the voltage step-down chip. The voltage step-down chip then decreases, according to a power supply requirement of the noise reduction chip, the 4 V voltage to voltage that helps supply power to the noise reduction chip, and it is assumed that the 4 V voltage is decreased to 1.8 V to supply power to the noise reduction chip.

In addition, the central processing unit transmits played music to the audio multimedia digital signal codec by using the audio bus 12S, the left audio output end m of the audio multimedia digital signal codec transmits the played music to an audio-left channel output end of the noise reduction chip by using an audio-left channel cable of a headset plug of the active noise reduction headset, and a right audio output end n of the audio multimedia digital signal codec transmits the played music to an audio-right channel output end of the noise reduction chip by using an audio-right channel cable of the headset plug of the active noise reduction headset, and the noise reduction chip transmits the music by using a left loudspeaker and a right loudspeaker. The left noise reduction microphone and the right noise reduction microphone receive external noise, and transmit the external noise to the noise reduction chip. The noise reduction chip processes the noise.

Further, when the user triggers a call answering button of the active noise reduction headset, a trigger signal is formed, the button switch Q is connected, and the resistor R1 is connected to the resistor R2 in series. As a result, a relatively large electric current passes through the resistor R2, for example, a 100-mA electric current. In addition, a relatively large voltage difference is formed at two ends of the resistor R2. The comparator acquires voltage at the two ends of the resistor R2, and then compares the voltage at the two ends of the resistor R2 to obtain the voltage difference, generates an interrupt signal according to the voltage difference, and transmits the interrupt signal to the central processing unit. The central processing unit interrupts or switches the music according to the interrupt signal. For example, assuming that the resistor R1 is 40 ohm, and the resistor R2 is 10 ohm, when the resistor R1 is connected to the resistor R2 in series, that is, 5 is divided by 50 ohm to obtain an electric current, that is, 0.1 A, voltage of the end b of the resistor R2 is 4 V, voltage of the end a of the resistor R2 is 5 V, and the voltage difference of the two ends of the resistor R2 is 1 V. As a result, the comparator outputs an interrupt signal of a low level. It should be noted that resistance of the resistor R2 cannot be too large, and the resistor R2 may be less than the resistor R1. If a value of the resistor R2 is relatively large, voltage divided from the power source voltage of the mobile phone is too large. As a result, the mobile phone cannot supply power to the active noise reduction headset.

If the microphone cable of the active noise reduction headset is occupied, that is, if the user is connected to the mobile phone by using the active noise reduction headset, the mobile phone is in a conversation state of a voice service, and when the microphone cable of the active noise reduction headset is occupied because after the microphone cable of the active noise reduction headset receives a voice signal of the user, the voice signal is output by using the microphone cable of the active noise reduction headset, the microphone cable of the active noise reduction headset is connected to a headset microphone cable M of the audio multimedia digital signal codec, transmits a voice of the user to the audio multimedia digital signal codec. The left audio output end m of the audio multimedia digital signal codec transmits the received voice to the audio-left channel output end of the noise reduction chip by using the audio-left channel cable of the headset plug of the active noise reduction headset, and the right audio output end n of the audio multimedia digital signal codec transmits the received voice to the audio-right channel output end of the noise reduction chip by using the audio-right channel cable of the headset plug of the active noise reduction headset; the noise reduction chip then outputs the received voice by using the left loudspeaker and the right loudspeaker. The left noise reduction microphone and the right noise reduction microphone receive external noise, and transmit the external noise to the noise reduction chip. The noise reduction chip processes the noise. It should be noted that the noise reduction chip is supplied with electric energy stored by the battery.

It should be noted that when the active noise reduction headset is connected to a terminal that cannot supply power to the active noise reduction headset, power may be supplied to the noise reduction chip by using the electric energy stored by the battery of the active noise reduction headset.

Specially, because the active noise reduction headset can acquire the electric energy by using the mobile phone connected to the active noise reduction headset, a capacity of the battery of the active noise reduction headset may be designed relatively small or the active noise reduction headset may have no battery, so that a volume of the active noise reduction headset is relatively small. For example, the capacity of the battery of the active noise reduction headset may be 20 mA. Compared with the prior art, the mobile phone connected to the active noise reduction headset can supply power to the active noise reduction headset, so that the noise reduction chip of the active noise reduction headset implements a noise reduction function. This can both effectively resolve a problem that a power supply operation of the active noise reduction headset is highly complex, and improve appearance of the active noise reduction headset, so that it is relatively convenient for a user to use and carry, and a level of user experience is relatively high.

Cables of a headset plug of the active noise reduction headset according to this embodiment of the present invention are successively an audio-left channel cable, an audio-right channel cable, a ground cable, and a microphone cable from left to right, which are provided for exemplary description only. There may be another connection method in practical application, which is not limited herein.

In another embodiment, exemplarily, based on the description in FIG. 10, it is assumed that a terminal is a mobile phone, and it is assumed that cables of a headset plug of an active noise reduction headset are successively an audio-left channel cable, an audio-right channel cable, a ground cable, and a microphone cable from left to right, and the active noise reduction headset is connected to the mobile phone, that is, the headset plug of the active noise reduction headset is inserted into a headset jack of the mobile phone. The mobile phone includes: a power source 60, a voltage step-up chip 70, a resistor R2, a comparator 80, an audio multimedia digital signal codec 90, and a central processing unit 100.

The power source 60 is separately connected to an input end of the voltage step-up chip 70 and an input end of the audio multimedia digital signal codec 90; an end a of the resistor R2 is connected to a first input end of the comparator 80, and an end b of the resistor R2 is separately connected to a microphone cable 1104 of the active noise reduction headset and a second input end of the comparator 80; an output end of the comparator 80 is connected to the central processing unit 100; a left audio output end m of the audio multimedia digital signal codec 90 is connected to an audio-left channel cable 1101 of the headset plug 110 of the active noise reduction headset, a right audio output end n of the audio multimedia digital signal codec 90 is connected to an audio-right channel cable 1102 of the headset plug 110 of the active noise reduction headset, and the audio multimedia digital signal codec 90 is connected to the central processing unit 100 by using an audio bus I2S. It should be noted that the microphone cable 1104 of the headset plug 110 of the active noise reduction headset may be connected to a headset microphone cable M of the audio multimedia digital signal codec 90, or may be connected to the end b of the resistor R2; the power source may be a lithium-ion battery.

Figure 12:
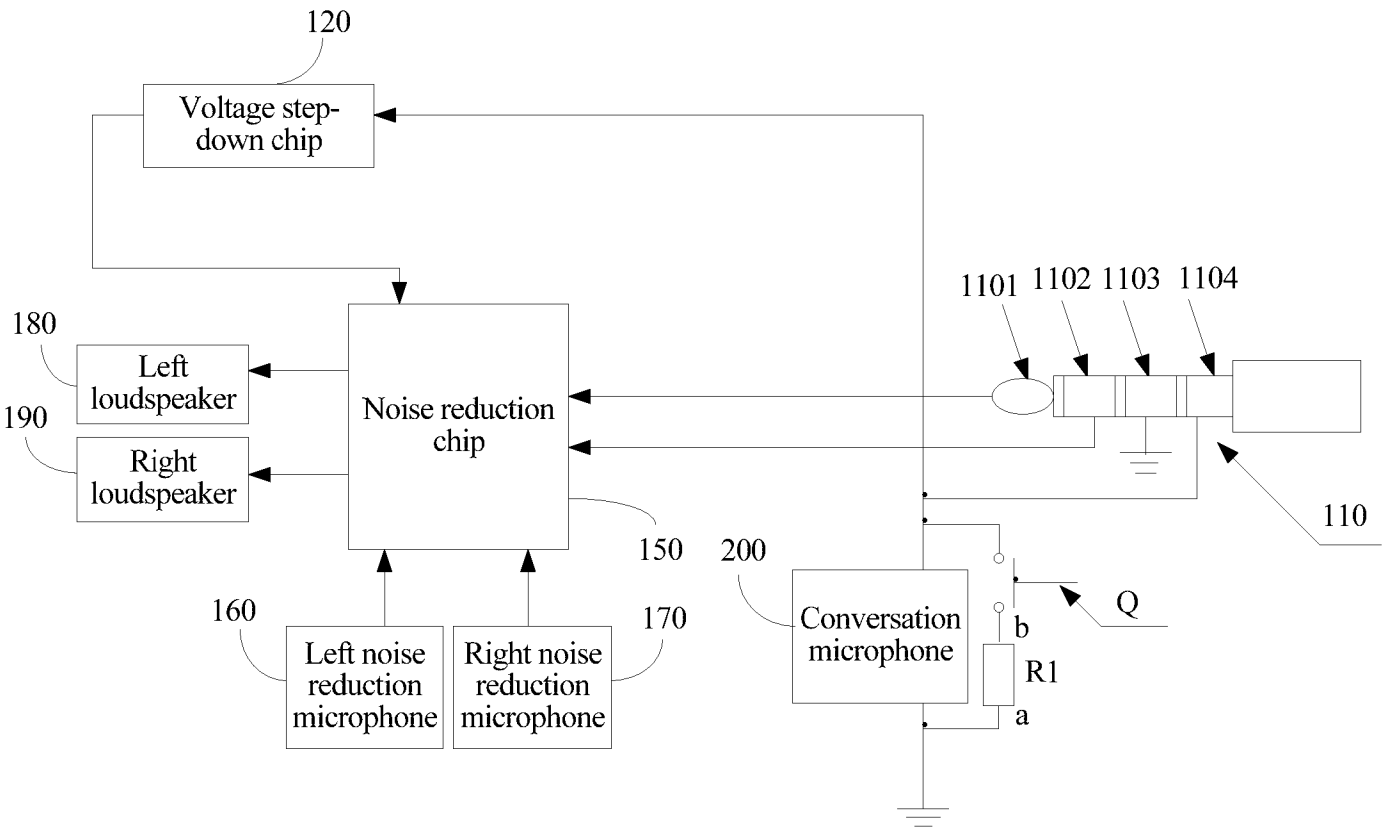
FIG. 12 is a schematic structural diagram of still yet another active noise reduction headset according to an embodiment of the present invention.

As shown in FIG. 12, an active noise reduction headset includes: the headset plug 110 of the active noise reduction headset, a voltage step-down chip 120, a noise reduction chip 150, a left noise reduction microphone 160, a right noise reduction microphone 170, a left loudspeaker 180, a right loudspeaker 190, a conversation microphone 200, a resistor R1, and a button switch Q. The headset plug 110 of the active noise reduction headset includes the audio-left channel cable 1101, the audio-right channel cable 1102, a ground cable 1103, and the microphone cable 1104.

The microphone cable 1104 of the active noise reduction headset is connected to an input end of the voltage step-down chip 120 and one end of the conversation microphone 200, the other end of the conversation microphone 200 is grounded, an output end of the voltage step-down chip 120 is connected to the noise reduction chip 150, the audio-right channel cable 1102 of the active noise reduction headset is connected to an audio-right channel input end of the noise reduction chip 150, an audio-right channel output end of the noise reduction chip 150 is connected to the right loudspeaker 190, the audio-left channel cable 1101 of the active noise reduction headset is connected to an audio-left channel input end of the noise reduction chip 150, an audio-left channel output end of the noise reduction chip 150 is connected to the left loudspeaker 180; the left noise reduction microphone 160 and the right noise reduction microphone 170 are separately connected to the noise reduction chip 150; an end a of the resistor R1 is grounded, and an end b of the resistor R1 is connected to the microphone cable 1104 of the active noise reduction headset. A size of the headset plug of the active noise reduction headset may be 3.5 mm with four segments.

A power source of the mobile phone is configured to supply power to the mobile phone and the active noise reduction headset. It is assumed that the power source of the mobile phone may provide power source voltage with a voltage range of 3.2 V to 4.2 V, and output voltage of the mobile phone is 5 V. It should be noted that in this embodiment of the present invention, a microphone cable of the active noise reduction headset is used as a power cable of the active noise reduction headset, and the mobile phone supplies power to the active noise reduction headset by using the microphone cable of the active noise reduction headset.

If the microphone cable of the active noise reduction headset is not occupied, that is, if a user does not use a microphone of the active noise reduction headset when the mobile phone is in a standby state or not in a conversation state of a voice service, it is assumed that the user listens to music by using the mobile phone connected to the active noise reduction headset when the power source voltage of the mobile phone is 4 V, and the microphone cable of the active noise reduction headset is connected to the end b of the resistor R2; first, a voltage step-up chip increases 4 V power source voltage provided by the power source of the mobile phone to 5 V output voltage of the mobile phone, and performs voltage division as minimum as possible by using the resistor R2, transmits, by using the microphone cable of the active noise reduction headset, a 5 V voltage signal after voltage division to the voltage step-down chip of the active noise reduction headset; then the voltage step-down chip decreases, according to a power supply requirement of the noise reduction chip, the 5 V voltage after voltage division to voltage that helps supply power to the noise reduction chip, and it is assumed that the 5 V voltage after voltage division is decreased to 1.8 V to supply power to the noise reduction chip.

In addition, the central processing unit transmits played music to the audio multimedia digital signal codec by using the audio bus I2S, the left audio output end m of the audio multimedia digital signal codec transmits the played music to an audio-left channel output end of the noise reduction chip by using an audio-left channel cable of a headset plug of the active noise reduction headset, and a right audio output end n of the audio multimedia digital signal codec transmits the played music to an audio-right channel output end of the noise reduction chip by using an audio-right channel cable of the headset plug of the active noise reduction headset, and the noise reduction chip transmits the music by using a left loudspeaker and a right loudspeaker. The left noise reduction microphone and the right noise reduction microphone receive external noise, and transmit the external noise to the noise reduction chip. The noise reduction chip processes the noise.

Further, when the user triggers a call answering button of the active noise reduction headset, a trigger signal is formed, the button switch Q is connected, and the resistor R1 is connected to the resistor R2 in series. As a result, a relatively large electric current passes through the resistor R2, for example, a 100-mA electric current. In addition, a relatively large voltage difference is formed at two ends of the resistor R2. The comparator acquires voltage at the two ends of the resistor R2, and then compares the voltage at the two ends of the resistor R2 to obtain the voltage difference, generates an interrupt signal according to the voltage difference, and transmits the interrupt signal to the central processing unit. The central processing unit interrupts or switches the music according to the interrupt signal. For example, assuming that the resistor R1 is 40 ohm, and the resistor R2 is 10 ohm, when the resistor R1 is connected to the resistor R2 in series, that is, 5 is divided by 50 ohm to obtain an electric current, that is, 0.1 A, voltage of the end b of the resistor R2 is 4 V, voltage of the end a of the resistor R2 is 5 V, and the voltage difference of the two ends of the resistor R2 is 1 V. As a result, the comparator outputs an interrupt signal of a low level, and can switch a song, suspend a song, or the like. It should be noted that resistance of the resistor R2 cannot be too large, and the resistor R2 may be less than the resistor R1. If a value of the resistor R2 is relatively large, voltage divided from the power source voltage of the mobile phone is too large. As a result, the mobile phone cannot supply power to the active noise reduction headset.

If the microphone cable of the active noise reduction headset is occupied, that is, if the mobile phone is in a conversation state of a voice service, and when the microphone cable of the active noise reduction headset is occupied because after a microphone of the active noise reduction headset receives a voice signal of a user, the voice signal is output by using the microphone cable of the active noise reduction headset, the microphone cable of the active noise reduction headset is connected to a headset microphone cable M of the audio multimedia digital signal codec, transmits a voice of the user to the audio multimedia digital signal codec. The left audio output end m of the audio multimedia digital signal codec transmits the received voice to the audio-left channel output end of the noise reduction chip by using the audio-left channel cable of the headset plug of the active noise reduction headset, and the right audio output end n of the audio multimedia digital signal codec transmits the received voice to the audio-right channel output end of the noise reduction chip by using the audio-right channel cable of the headset plug of the active noise reduction headset; the noise reduction chip then outputs the received voice by using the left loudspeaker and the right loudspeaker. It should be noted that in this case, the active noise reduction headset cannot supply power to the noise reduction chip by using the microphone cable.

Specially, because the active noise reduction headset can acquire the electric energy by using the mobile phone connected to the active noise reduction headset, the active noise reduction headset may have no battery, so that a volume of the active noise reduction headset is relatively small. Compared with the prior art, the mobile phone connected to the active noise reduction headset can supply power to the active noise reduction headset, so that the noise reduction chip of the active noise reduction headset implements a noise reduction function. This can both effectively resolve a problem that a power supply operation of the active noise reduction headset is highly complex, and improve appearance of the active noise reduction headset, so that it is relatively convenient for a user to use and carry, and a level of user experience is relatively high.

Cables of a headset plug of the active noise reduction headset according to this embodiment of the present invention are successively an audio-left channel cable, an audio-right channel cable, a ground cable, and a microphone cable from left to right, which are provided for exemplary description only. There may be another connection method in practical application, which is not limited herein.

Figure 13:
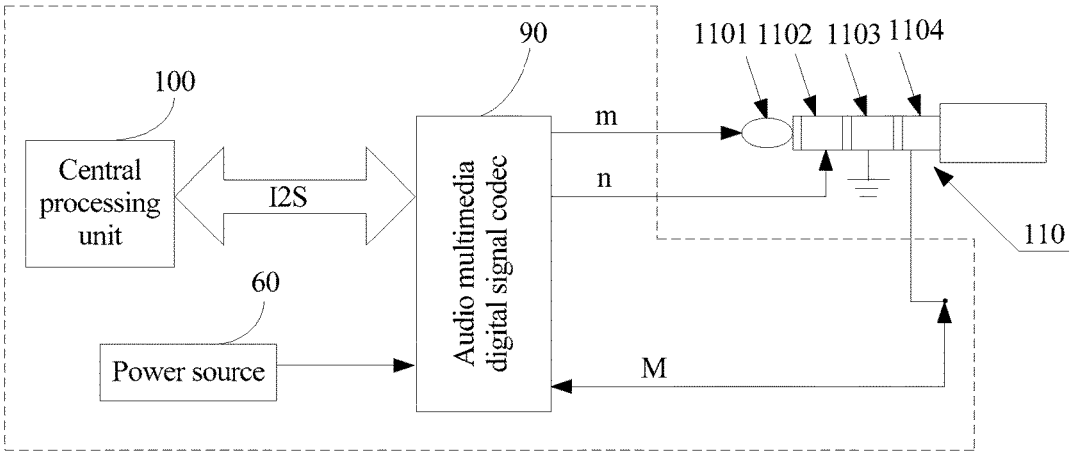
FIG. 13 is a schematic structural diagram of another mobile phone according to an embodiment of the present invention.

In yet another embodiment, exemplarily, it is assumed that a terminal is a mobile phone, and it is assumed that cables of a headset plug of an active noise reduction headset are successively an audio-left channel cable, an audio-right channel cable, a ground cable, and a microphone cable from left to right, and the active noise reduction headset is connected to the mobile phone, that is, the headset plug of the active noise reduction headset is inserted into a headset jack of the mobile phone. As shown in FIG. 13, the mobile phone includes: a power source 60, an audio multimedia digital signal codec 90, and a central processing unit 100.

The power source 60 is connected to an input end of the audio multimedia digital signal codec 90; the left audio output end m of the audio multimedia digital signal codec 90 is connected to an audio-left channel cable 1101 of a headset plug 110 of the active noise reduction headset, a right audio output end n of the audio multimedia digital signal codec 90 is connected to an audio-right channel cable 1102 of the headset plug 110 of the active noise reduction headset, the audio multimedia digital signal codec 90 is connected to the central processing unit 100 by using an audio bus I2S, and a headset microphone cable M of the audio multimedia digital signal codec 90 is connected to a microphone cable 1104 of the headset plug 110 of the active noise reduction headset. The power source may be a lithium-ion battery.

As shown in FIG. 11, the active noise reduction headset may include: the headset plug 110 of the active noise reduction headset, a voltage step-down chip 120, a battery 130, a charging chip 140, a noise reduction chip 150, a left noise reduction microphone 160, a right noise reduction microphone 170, a left loudspeaker 180, a right loudspeaker 190, a conversation microphone 200, a resistor R1, and a button switch Q. The headset plug 110 of the active noise reduction headset includes the audio-left channel cable 1101, the audio-right channel cable 1102, a ground cable 1103, and the microphone cable 1104.

The microphone cable 1104 of the active noise reduction headset is connected to an input end of the charging chip 140 and one end of the conversation microphone 200, the other end of the conversation microphone 200 is grounded, an output end of the charging chip 140 is connected to an input end of the voltage step-down chip 120, the battery 130 is separately connected to the output end of the charging chip 140 and the input end of the voltage step-down chip 120, an output end of the voltage step-down chip 120 is connected to the noise reduction chip 150, the audio-right channel cable 1102 of the active noise reduction headset is connected to an audio-right channel input end of the noise reduction chip 150, an audio-right channel output end of the noise reduction chip 150 is connected to the right loudspeaker 190, the audio-left channel cable 1101 of the active noise reduction headset is connected to an audio-left channel input end of the noise reduction chip 150, an audio-left channel output end of the noise reduction chip 150 is connected to the left loudspeaker 180; the left noise reduction microphone 160 and the right noise reduction microphone 170 are separately connected to the noise reduction chip 150; an end a of the resistor R1 is grounded, and an end b of the resistor R1 is connected to the microphone cable 1104 of the active noise reduction headset. Generally, a battery may be a lithium-ion battery, and voltage of the lithium-ion battery ranges from 3.2 V to 4.2 V. A size of the headset plug of the active noise reduction headset may be 3.5 mm with four segments.

In this embodiment of the present invention, it is assumed that the mobile phone cannot supply power to the active noise reduction headset, the battery of the active noise reduction headset stores electric energy, and voltage is 4 V.

If a user does not use a microphone of the active noise reduction headset when the mobile phone is in a standby state or not in a conversation state of a voice service, when the user listens to music by using the mobile phone connected to the active noise reduction headset, the battery of the active noise reduction headset transmits 4 V voltage to a voltage step-down chip; the voltage step-down chip then decreases, according to a power supply requirement of the noise reduction chip, the 4 V voltage to voltage that helps supply power to the noise reduction chip. It is assumed that the 4 V voltage is decreased to 1.8 V to supply power to the noise reduction chip.

In addition, the central processing unit transmits played music to the audio multimedia digital signal codec by using the audio bus I2S, the left audio output end m of the audio multimedia digital signal codec transmits the played music to an audio-left channel output end of the noise reduction chip by using an audio-left channel cable of a headset plug of the active noise reduction headset, and a right audio output end n of the audio multimedia digital signal codec transmits the played music to an audio-right channel output end of the noise reduction chip by using an audio-right channel cable of the headset plug of the active noise reduction headset, and the noise reduction chip transmits the music by using a left loudspeaker and a right loudspeaker. The left noise reduction microphone and the right noise reduction microphone receive external noise, and transmit the external noise to the noise reduction chip. The noise reduction chip processes the noise.

If the microphone cable of the active noise reduction headset is occupied, that is, if the user is connected to the mobile phone by using the active noise reduction headset, the mobile phone is in a conversation state of a voice service, and when the microphone cable of the active noise reduction headset is occupied because after the microphone cable of the active noise reduction headset receives a voice signal of the user, the voice signal is output by using the microphone cable of the active noise reduction headset, the microphone cable of the active noise reduction headset is connected to a headset microphone cable M of the audio multimedia digital signal codec, transmits a voice of the user to the audio multimedia digital signal codec. The left audio output end m of the audio multimedia digital signal codec transmits the received voice to the audio-left channel output end of the noise reduction chip by using the audio-left channel cable of the headset plug of the active noise reduction headset, and the right audio output end n of the audio multimedia digital signal codec transmits the received voice to the audio-right channel output end of the noise reduction chip by using the audio-right channel cable of the headset plug of the active noise reduction headset; the noise reduction chip then outputs the received voice by using the left loudspeaker and the right loudspeaker. The left noise reduction microphone and the right noise reduction microphone receive external noise, and transmit the external noise to the noise reduction chip. The noise reduction chip processes the noise. It should be noted that the battery of the active noise reduction headset transmits the 4 V voltage to the voltage step-down chip; the voltage step-down chip then decreases, according to a power supply requirement of the noise reduction chip, the 4 V voltage to voltage that helps supply power to the noise reduction chip. It is assumed that the 4 V voltage is decreased to 1.8 V to supply power to the noise reduction chip.

Specially, a capacity of the battery of the active noise reduction headset may be designed relatively small, so that a volume of the active noise reduction headset is relatively small, for example, when the capacity of the battery of the active noise reduction headset may be 20 mA. Compared with the prior art, the battery of the active noise reduction headset supplies power to the noise reduction chip of the active noise reduction headset, so that the noise reduction chip of the active noise reduction headset implements a noise reduction function. This can both effectively resolve a problem that a power supply operation of the active noise reduction headset is highly complex, and improve appearance of the active noise reduction headset, so that it is relatively convenient for a user to use and carry, and a level of user experience is relatively high. If electric energy of the battery of the active noise reduction headset is insufficient, the active noise reduction headset may also be connected to the mobile phone that provides electric energy to the active noise reduction headset. The active noise reduction headset acquires electric energy by using the mobile phone, and charges the battery of the active noise reduction headset.

Cables of a headset plug of the active noise reduction headset according to this embodiment of the present invention are successively an audio-left channel cable, an audio-right channel cable, a ground cable, and a microphone cable from left to right, which are provided for exemplary description only. There may be another connection method in practical application, which is not limited herein.

An active noise reduction headset according to the present invention may be connected to a mobile phone that cannot provide electric energy to the active noise reduction headset, and power is supplied to a noise reduction chip of the active noise reduction headset by using a battery of the active noise reduction headset, so that the noise reduction chip of the active noise reduction headset implements a noise reduction function. The active noise reduction headset may further be connected to a mobile phone that provides electric energy to the active noise reduction headset, and power is supplied to the noise reduction chip of the active noise reduction headset by using the electric energy of the mobile phone, so that the noise reduction chip of the active noise reduction headset implements the noise reduction function. In addition, the mobile phone charges the battery of the active noise reduction headset. Further, after the battery of the active noise reduction headset is fully charged, if the mobile phone is still connected to the active noise reduction headset, power may further be supplied to the active noise reduction headset. In this case, the active noise reduction headset can supply power to the noise reduction chip of the active noise reduction headset by using the electric energy of the battery of the active noise reduction headset, or can supply power to the noise reduction chip of the active noise reduction headset by using the electric energy of the mobile phone, and the latter is preferred. This can avoid a case in which when the battery of the active noise reduction headset is used after fully charged, lifetime of the battery is shortened because the battery is repeatedly charged by using the electric energy of the mobile phone. Specially, the active noise reduction headset may have no battery, and is directly connected to a mobile phone that provides electric energy to the active noise reduction headset. Power is supplied to the noise reduction chip of the active noise reduction headset by using the electric energy of the mobile phone, so that the noise reduction chip of the active noise reduction headset implements a noise reduction function. It should be noted that a capacity of the battery of the active noise reduction headset may be designed relatively small, so that a volume of the active noise reduction headset is relatively small, for example, when the capacity of the battery of the active noise reduction headset may be 20 mA. This can both effectively resolve a problem that a power supply operation of the active noise reduction headset is highly complex, and improve appearance of the active noise reduction headset, so that it is relatively convenient for a user to use and carry, and a level of user experience is relatively high.

Figure 14:
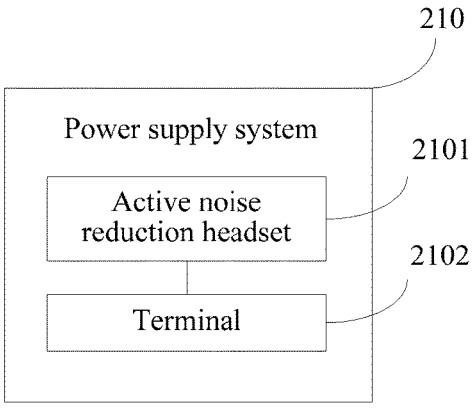
FIG. 14 is a schematic structural diagram of a power supply system according to an embodiment of the present invention.

An embodiment of the present invention provides a power supply system 210, as shown in FIG. 14, including: an active noise reduction headset 2101 and a terminal 2102.

The terminal 2102 is configured to acquire a signal of power source voltage provided by a power source of the terminal, process the signal of the power source voltage of the terminal to obtain a signal of first voltage, where the power source voltage is less than the first voltage; and transmit the signal of the first voltage to the active noise reduction headset, so that the active noise reduction headset processes the signal of the first voltage to obtain a signal of second voltage, where the signal of the second voltage is transmitted to a noise reduction chip of the active noise reduction headset, so that the noise reduction chip of the active noise reduction headset acquires the signal of the second voltage to implement a noise reduction function, where the second voltage is less than the first voltage.

The active noise reduction headset 2101 is configured to receive the signal of the first voltage transmitted by the terminal; and process the signal of the first voltage to obtain the signal of the second voltage, where the second voltage is less than the first voltage, and the signal of the second voltage is transmitted to the noise reduction chip of the active noise reduction headset, so that the noise reduction chip of the active noise reduction headset acquires the signal of the second voltage to implement a noise reduction function.

According to the method for supplying power to an active noise reduction headset provided in this embodiment of the present invention, after the active noise reduction headset is connected to a terminal, first, the terminal processes a signal of power source voltage of the terminal to obtain a signal of first voltage, and transmits the signal of the first voltage to the active noise reduction headset; then, the active noise reduction headset receives the signal of the first voltage transmitted by the terminal, processes the signal of the first voltage to obtain a signal of second voltage, transmits the signal of the second voltage to a noise reduction chip of the active noise reduction headset, so that the noise reduction chip of the active noise reduction headset acquires the signal of the second voltage to implement a noise reduction function. Compared with the prior art, the terminal connected to the active noise reduction headset can supply power to the active noise reduction headset, so that the noise reduction chip of the active noise reduction headset implements the noise reduction function, which can effectively resolve a problem that a power supply operation of the active noise reduction headset is highly complex.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit. The integrated unit may be implemented in a form of hardware, or may be implemented in a form of hardware in addition to a software functional unit.

A person of ordinary skill in the art may understand that all or some of the steps of the method embodiments may be implemented by a program instructing relevant hardware. The program may be stored in a computer readable storage medium. When the program runs, the steps of the method embodiments are performed. The foregoing storage medium includes: any medium that can store program code, such as a ROM, a RAM, a magnetic disk, or an optical disc.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A method for supplying power to an active noise reduction headset, wherein the active noise reduction headset is connected to a terminal, and the method comprises:

receiving, by the active noise reduction headset, a signal of first voltage transmitted by the terminal, wherein the signal of the first voltage is received using a microphone cable of the active noise reduction headset;

processing, by the active noise reduction headset, the signal of the first voltage to obtain a signal of third voltage, wherein the third voltage is less than the first voltage and wherein the signal of the third voltage is transmitted to a rechargeable battery of the active noise reduction headset, so that the rechargeable battery stores the signal of the third voltage;

in response to the microphone cable of the active noise reduction headset being occupied, processing, by the active noise reduction headset, the signal of the third voltage stored on the rechargeable battery to obtain a signal of second voltage, wherein the third voltage is greater than the second voltage, wherein the second voltage is less than the first voltage; and in response to the microphone cable of the active noise reduction headset being available, processing, by the active noise reduction headset, the signal of the first voltage to obtain the signal of the second voltage;

wherein the signal of the second voltage is transmitted to a noise reduction chip of the active noise reduction headset, so that the noise reduction chip of the active noise reduction headset acquires the signal of the second voltage to implement a noise reduction function, wherein after the receiving a signal of first voltage transmitted by the terminal, the method further comprises:

receiving, by the active noise reduction headset by using the microphone cable of the active noise reduction headset, a trigger signal triggered by a user; and transmitting, by the active noise reduction headset, the trigger signal to the terminal by using the microphone cable of the active noise reduction headset, so that the terminal interrupts or switches a transmit signal of the terminal according to the trigger signal, wherein the transmit signal is a data signal or a voice signal transmitted by the terminal to the active noise reduction headset, wherein the trigger signal comprises forming a voltage difference at two ends of a resistor, wherein a first end of the resistor is connected to a first input of a comparator and a second end of the resistor is connected to a second input of the comparator, and wherein the transmit signal is interrupted based on the voltage difference between the two ends of the resistor.

2. A method for supplying power to an active noise reduction headset, wherein the active noise reduction headset is connected to a terminal, and the method comprises:

acquiring, by the terminal, a signal of power source voltage provided by a power source of the terminal;

processing, by the terminal, the signal of the power source voltage of the terminal to obtain a signal of first voltage, wherein the power source voltage is less than the first voltage;

in response to a microphone cable of the active noise reduction headset being available, transmitting, by the terminal, the signal of the first voltage to the active noise reduction headset, so that the active noise reduction headset processes the signal of the first voltage to obtain a signal of second voltage, wherein the signal of the second voltage is transmitted to a noise reduction chip of the active noise reduction headset, so that the noise reduction chip of the active noise reduction headset acquires the signal of the second voltage to implement a noise reduction function, wherein the second voltage is less than the first voltage; and wherein the microphone cable of the active noise reduction headset is occupied when the terminal receives voice signal from the microphone cable of the active noise reduction headset, wherein after the transmitting the signal of the first voltage to the active noise reduction headset, the method further comprises:

receiving, by the terminal, a trigger signal transmitted by the microphone cable of the active noise reduction headset, wherein the trigger signal is generated by a user by means of triggering; and interrupting or switching, by the terminal, a transmit signal of the terminal according to the trigger signal, wherein the transmit signal is a data signal or a voice signal transmitted by the terminal to the active noise reduction headset, wherein the trigger signal comprises forming a voltage difference at two ends of a resistor, wherein a first end of the resistor is connected to a first input of a comparator and a second end of the resistor is connected to a second input of the comparator, and wherein the transmit signal is interrupted based on the voltage difference between the two ends of the resistor.

3. An active noise reduction headset, wherein the active noise reduction headset is connected to a terminal, and the active noise reduction headset comprises:

a receiver circuit, configured to receive via a microphone cable of the active noise reduction headset, a signal of first voltage transmitted by the terminal;

a voltage step-down circuit comprising:

a first processing circuit, configured to process the signal of the first voltage to obtain a signal of third voltage, wherein the third voltage is less than the first voltage and wherein the signal of the third voltage is transmitted to a rechargeable battery of the active noise reduction headset, so that the rechargeable battery stores the signal of the third voltage, and a second processing circuit, configured to in response to the microphone cable of the active noise reduction headset being occupied, process the signal of the third voltage to obtain a signal of second voltage, wherein the third voltage is greater than the second voltage, and wherein the second voltage is less than the first voltage, and in response to the microphone cable of the active noise reduction headset being available, process the signal of the first voltage to obtain the signal of the second voltage; and acquire the signal of the second voltage to implement a noise reduction function, wherein:

the receiver circuit is further configured to receive, by using the microphone cable of the active noise reduction headset, a trigger signal triggered by a user; and the active noise reduction headset further comprises:

a trigger circuit, configured to transmit the trigger signal to the terminal by using the microphone cable of the active noise reduction headset, so that the terminal interrupts or switches a transmit signal of the terminal according to the trigger signal, wherein the transmit signal is a data signal or a voice signal transmitted by the terminal to the active noise reduction headset, wherein the trigger signal comprises forming a voltage difference at two ends of a resistor, wherein a first end of the resistor is connected to a first input of a comparator and a second end of the resistor is connected to a second input of the comparator, and wherein the transmit signal is interrupted based on the voltage difference between the two ends of the resistor.

4. The active noise reduction headset according to claim 3, wherein the second processing circuit comprises:

a voltage step-down chip, wherein an input end of the voltage step-down chip is connected to the microphone cable of the active noise reduction headset, and an output end of the voltage step-down chip is connected to an input end of the noise reduction chip of the active noise reduction headset.

5. The active noise reduction headset according to claim 3, wherein:

the first processing circuit comprises a charging chip, and the second processing circuit comprises a voltage step-down chip; wherein an input end of the charging chip is connected to the microphone cable of the active noise reduction headset, one end of the rechargeable battery is separately connected to an output end of the charging chip and an input end of the voltage step-down chip, the other end of the rechargeable battery is grounded, and an output end of the voltage step-down chip is connected to an input end of the noise reduction chip of the active noise reduction headset.

6. The active noise reduction headset according to claim 3, wherein the trigger circuit comprises:

a button switch and a resistor R1, wherein one end of the resistor R1 is grounded, the other end of the resistor R1 is connected to the button switch in series, the button switch is connected to the microphone cable of the active noise reduction headset, and when a trigger signal indicating that the user triggers the active noise reduction headset is received by using the microphone cable of the active noise reduction headset, the button switch and the resistor R1 are conducted.

7. A terminal, wherein the terminal is connected to an active noise reduction headset, and the terminal comprises:

a power source, configured to provide power source voltage to the terminal; and a voltage step-up circuit, configured to:

process a signal of the power source voltage of the terminal to obtain a signal of first voltage, wherein the power source voltage is less than the first voltage, and in response to a microphone cable of the active noise reduction headset being available, transmit the signal of the first voltage to the active noise reduction headset, so that the active noise reduction headset processes the signal of the first voltage to obtain a signal of second voltage, wherein the signal of the second voltage is transmitted to a noise reduction chip of the active noise reduction headset, so that the noise reduction chip of the active noise reduction headset acquires the signal of the second voltage to implement a noise reduction function, wherein the second voltage is less than the first voltage;

wherein the microphone cable of the active noise reduction headset is occupied when the terminal receives voice signal from the microphone cable of the active noise reduction headset, wherein the terminal further comprises:

a trigger circuit, configured to receive a trigger signal transmitted by the microphone cable of the active noise reduction headset, wherein the trigger signal is generated by a user by means of triggering; and the trigger circuit is further configured to interrupt or switch a transmit signal of the terminal according to the trigger signal, wherein the transmit signal is a data signal or a voice signal transmitted by the terminal to the active noise reduction headset, wherein the trigger signal comprises forming a voltage difference at two ends of a resistor, wherein a first end of the resistor is connected to a first input of a comparator and a second end of the resistor is connected to a second input of the comparator, and wherein the transmit signal is interrupted based on the voltage difference between the two ends of the resistor.

8. The terminal according to claim 7, wherein the voltage step-up circuit comprises:

a voltage step-up chip, wherein an input end of the voltage step-up chip is connected to an output end of the power source of the terminal, and an output end of the voltage step-up chip is connected to the microphone cable of the active noise reduction headset.

9. The terminal according to claim 7, wherein the trigger circuit comprises:

a resistor R2 and a comparator; wherein one end of the resistor R2 is separately connected to the output end of the voltage step-up chip and a first input end of the comparator, and the other end of the resistor R2 is separately connected to the microphone cable of the active noise reduction headset and a second input end of the comparator.

10. The method according to claim 2, wherein the voltage difference is formed based on an electric current of 100 mA passing through the resistor.

* * * * *